US005703602A

United States Patent [19]

Casebolt

[11] Patent Number: 5,703,602

[45] Date of Patent: Dec. 30, 1997

[54] PORTABLE RF ANTENNA

[75] Inventor: Matthew Phillip Casebolt, Fremont, Calif.

[73] Assignee: Metricom, Inc., Los Gatos, Calif.

[21] Appl. No.: 663,883

[22] Filed: Jun. 14, 1996

[51] Int. Cl.[6] ..... H01Q 1/24

[52] U.S. Cl. ..... 343/702; 343/724; 343/821; 343/803

[58] Field of Search ..... 343/702, 901, 343/900, 823, 723, 724, 793, 820, 821, 822, 859, 803; H01Q 1/24

[56] References Cited

U.S. PATENT DOCUMENTS

| | | | |
|---|---|---|---|
| 4,958,382 | 9/1990 | Imanishi | 343/702 |
| 5,528,251 | 6/1996 | Frein | 343/822 |
| 5,561,437 | 10/1996 | Phillips et al. | 343/702 |

OTHER PUBLICATIONS

Shuhao, Hu, "The Balun Family," *Microwave Journal*, pp. 227–229, Sep. 1997.

*Primary Examiner*—Hoanganh T. Le

*Attorney, Agent, or Firm*—Townsend and Townsend and Crew, LLP

[57] ABSTRACT

A small, collapsible, high-gain, dipole antenna and a method to make the antenna. The present invention provides a collapsible half-wavelength dipole antenna for use in a portable device, the antenna having a fully collapsed position and a fully extended position. The antenna includes a static dipole arm, and a movable dipole arm. The movable dipole arm is capable of being moved to the fully collapsed position and the fully extended position. The antenna also includes a balun feed assembly electrically coupled to the static dipole arm and to the movable dipole arm. The antenna is capable of transmitting and receiving electrical signals in either the fully collapsed position or the fully extended position. The balun feed assembly is fixed to the static dipole arm, and the movable dipole arm is movably coupled to the balun feed assembly. According to specific embodiments, the antenna may include a static dipole arm positioned adjacent and parallel to the balun feed assembly to provide a folded dipole antenna when in the fully collapsed position. In accordance with other embodiments, the movable dipole arm of the present antenna may be, for example, retracted or rotated into its collapsed position.

24 Claims, 7 Drawing Sheets

PORTABLE RF ANTENNA

BACKGROUND OF THE INVENTION

This invention relates to radio frequency (RF) antennas. More particularly, in a specific embodiment, the invention relates to RF antennas for portable applications.

With the increasing popularity of cellular and mobile phones, the demand for smaller, lighter portable telephones provided with quality electronics is growing. The ability of the portable telephone to transmit and receive RF signals adequate for communication from many possible locations is of key importance in portable telephones. Accordingly, a high-gain, omni-directional antenna for portable telephones is needed. Optimally, such an antenna should be able to exhibit a voltage standing-wave ratio (VSWR) of less than about 3.0:1 over the operating frequency range.

Typical antennas used in portable devices have been large, non-collapsible dipoles, or collapsible half-wave to quarter-wave monopoles. A dipole is better suited for smaller electronic devices because of its ground-plane independence. However, the industry has not been able to produce a collapsible dipole antenna capable of providing adequate performance over the operating frequency range. These large dipole antennas for use in portable devices could not be collapsed without encountering serious VSWR and gain problems. The use of retractable monopoles has been advantageous due to increasing concerns with portability of telephone equipment.

Accordingly, it is seen that a small, collapsible, high-gain, dipole antenna is desirable for use in portable devices.

SUMMARY OF THE INVENTION

According to the invention, a small, collapsible, high-gain, dipole antenna and a method to make the antenna are provided. The present invention provides a collapsible half-wavelength dipole antenna for use in a portable device, the antenna having a fully collapsed position and a fully extended position. The antenna includes a static dipole arm, and a movable dipole arm. The movable dipole arm is capable of being moved to the fully collapsed position and the fully extended position. The antenna also includes a balun feed assembly electrically coupled to the static dipole arm and to the movable dipole arm. The antenna is capable of transmitting and receiving electrical signals in either the fully collapsed position or the fully extended position. The balun feed assembly is fixed to the static dipole arm, and the movable dipole arm is movably coupled to the balun feed assembly. According to specific embodiments, the antenna may include a static dipole arm positioned adjacent and parallel to the balun feed assembly to provide a folded dipole antenna when in the fully collapsed position. In accordance with other embodiments, the movable dipole arm of the present antenna may be, for example, retracted or rotated into its collapsed position.

In accordance with another embodiment, the present invention provides a method of making a collapsible half-wavelength dipole antenna for use in a portable device. The method includes the steps of providing a balun feed assembly, and providing a static dipole arm and a movable dipole arm, both coupled to the balun feed assembly. The movable dipole arm is capable of being moved into a collapsed position and an extended position. The method also includes the step of optimizing performance of the antenna by varying different dimensions of the antenna to produce an antenna capable of acceptable gain and VSWR in both the collapsed and extended positions.

These and other embodiments of the present invention, as well as its advantages and features are described in more detail in conjunction with the text below and attached figures.

BRIEF DESCRIPTION OF THE DRAWINGS

FIG. 1(*d*) is a general illustration of the collapsible dipole antenna in a portable device in accordance with an alternative specific embodiment of the invention;

FIG. 2(*a*) is a detailed diagram of a view N shown in FIG. 2, in accordance with a specific embodiment of the invention;

FIG. 2(*b*) is a detailed diagram of a view M shown in FIG. 2, in accordance with a specific embodiment of the invention;

DESCRIPTION OF THE SPECIFIC EMBODIMENTS

Figure 1A:
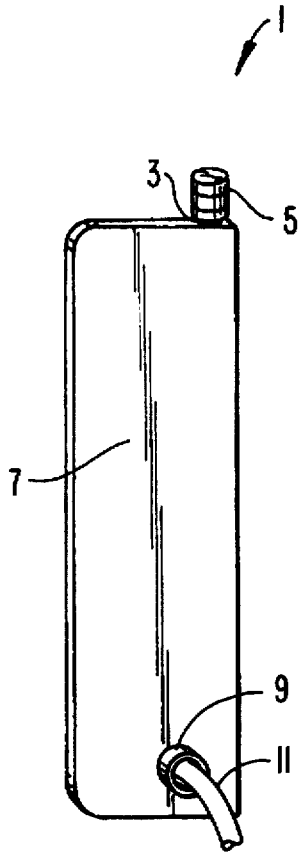
FIGS. 1(*a*)–1(*c*) are general illustrations of the collapsible dipole antenna in a portable device in accordance with a specific embodiment of the invention.
Figure 1B:
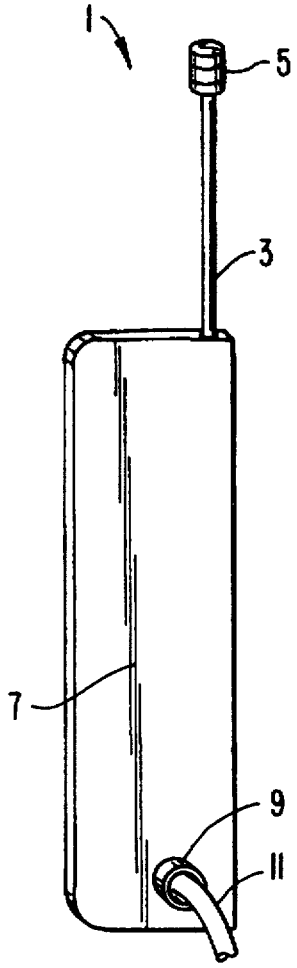
Figure 1C:
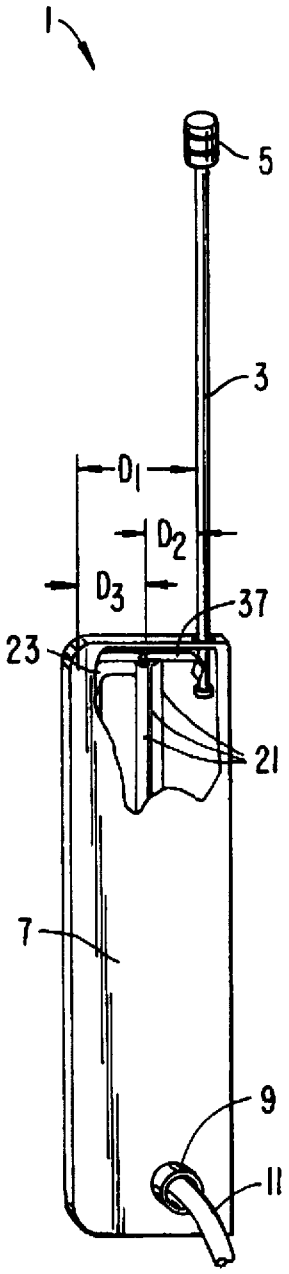
Figure 1D:
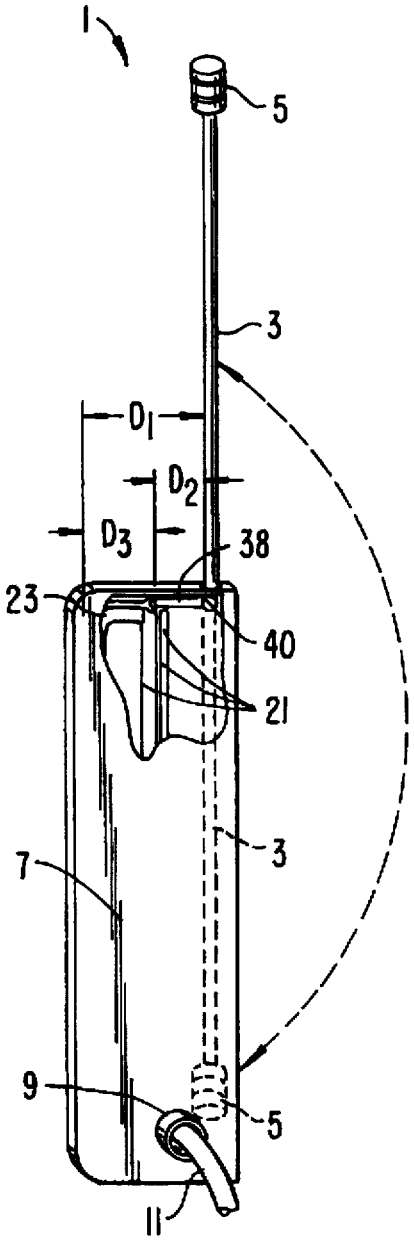

FIGS. 1(*a*)–1(*c*) generally illustrate the collapsible half-wave dipole antenna 1 for use in a portable device (not shown) in accordance with a specific embodiment of the present invention. The dipole has an electrical length which is preferably half of the wavelength of the operating center frequency. In a specific embodiment, the operating center frequency is about 915 Megahertz (MHz), which corresponds to an electrical length on the order of 16 centimeters (cm). Of course, half-wave dipole electrical lengths vary depending on the frequency used. The preferred embodiment of the present antenna operates with good gain and good VSWR in its fully extended position, and it operates with acceptable gain and even better VSWR in its fully collapsed position. Accordingly, the present antenna allows for good performance and use in the portable device in either collapsed or extended positions.

In particular, FIG. 1(*a*) illustrates collapsible dipole antenna 1 in a fully collapsed position within a portable device (not shown). The portable device, which may be a portable telephone in a specific embodiment, includes collapsible dipole antenna 1, fully collapsed in FIG. 1(*a*). In the fully collapsed position, a movable dipole arm 3 is completely encased within an outer case (or radome) 7 of antenna 1, with only a tip 5 protruding from and in contact with outer case 7. Outer case 7 may be constructed of an RF-transparent dielectric, such as a rubberized plastic, or the like material to house the antenna and feed assembly without shielding. Outer case 7 includes an access port 9, which allows access to the antenna feed assembly (not shown in FIG. 1(*a*)) contained within outer case 7. Accordingly, a coaxial input cable 11 feeds the dipole antenna 1 via access port 9. Coaxial input cable 11 may be connected at the other end to a transmitter/receiver of the portable device, e.g., a mobile car phone unit or a mobile cellular phone unit. Dipole arm 3 may be a rigid or semi-rigid rod made of conducting material having a specific diameter. Movable dipole arm 3 is capable of moving through a hole in outer case 7. The hole has a diameter slightly larger than the diameter of movable dipole arm 3. Tip 5, fixed in a position at the top of movable dipole arm 3, is large enough compared to the hole to prevent the length of movable dipole arm 3 from becoming lost within outer case 7, and is useful to grip in pulling out movable dipole arm 3. A detent, such as an indented ring, may be located near the top of arm 3 below tip 5 to hold movable dipole arm 3 in its collapsed position relative to outer case 7. In the fully collapsed position, antenna 1 is a half-wave folded dipole fed by a single-line symmetrical balun 21 as hereinafter described.

FIG. 1(*b*) illustrates movable dipole arm 3 in a partially extended position from outer case 7 of the portable device, in accordance with a specific embodiment. In the partially extended position, movable dipole arm 3 is only partially encased within outer case 7. Tip 5 has been pulled away from and out of contact with outer case 7, exposing a partial length of movable dipole arm 3.

FIG. 1(*c*) illustrates movable dipole arm 3 in a fully extended position from outer case 7 of the portable device. In the fully extended position, tip 5 has been pulled out of outer case 7, and virtually the full length of movable dipole arm 3 is withdrawn from outer case 7. A detent (not shown) may be located near the base of dipole arm 3 to hold arm 3 in its fully extended position relative to outer case 7. A cut-out view of a portion of outer case 7 in FIG. 1(*c*) illustrates part of the antenna's balun feed assembly 21 within outer case 7. When in a fully extended position, antenna 1 is a half-wave dipole fed by a single-line symmetrical balun, as hereinafter described.

FIG. 1(*d*) illustrates movable dipole arm 3 in a fully extended position from outer case 7 of the portable device (not shown), according to an alternative specific embodiment that uses a fixed contact 38 and a pivot joint 40 instead of a sliding contact 37 seen in FIG. 1(*c*). In the fully extended position, tip 5 is located away from outer case 7 and virtually the full length of movable dipole arm 3 is outside and away from outer case 7. A cut-out view of a portion of outer case 7 in FIG. 1(*d*) illustrates part of the antenna's balun feed assembly 21 and static arm 23 within outer case 7. When in a fully extended position, antenna 1 is a half-wave dipole fed by a single-line symmetrical balun, as hereinafter described. FIG. 1(*d*) also illustrates collapsible dipole antenna 1 (dotted outline) in a fully collapsed position within a portable device (not shown). In the fully collapsed position, movable dipole arm 3 is within an indentation of outer case 7 of antenna 1. Outer case 7 includes an access port 9, which allows access to the antenna feed assembly (partially shown in FIG. 1(*d*)) contained within outer case 7. Movable dipole arm 3 is capable of being pivoted at joint 40 to move along a plane (formed by balun 21, static arm 23, and arm 3) to rest within the indentation located on the side of outer case 7. The indentation has dimensions slightly larger than the dimensions of movable dipole arm 3 to accommodate arm 3. In this embodiment, when arm 3 is fully collapsed, tip 5 is located close to the base of the balun assembly 21. In the fully collapsed position, antenna 1 is a half-wave folded dipole fed by a single-line symmetrical balun 21 as hereinafter described.

Figure 2A:
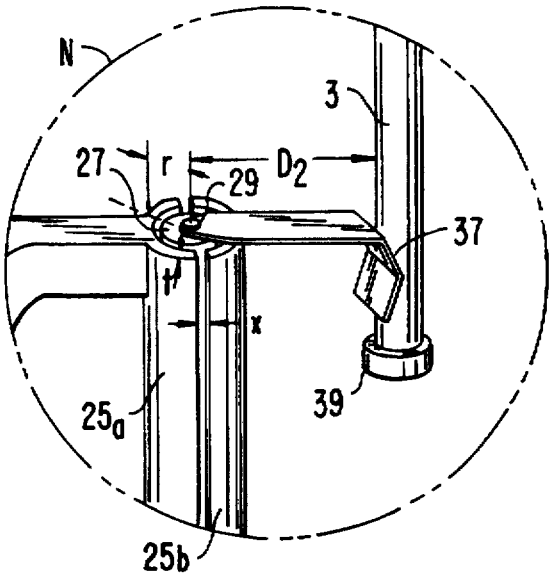
FIG. 2 is a detailed diagram of the collapsible dipole antenna in a fully extended position according to a specific embodiment of the invention.
Figure 2:
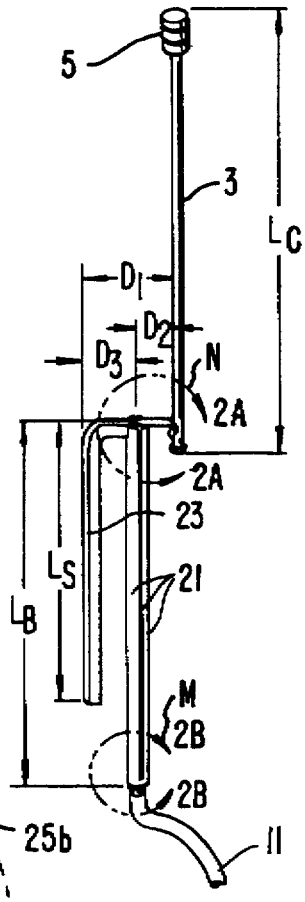
Figure 2B:
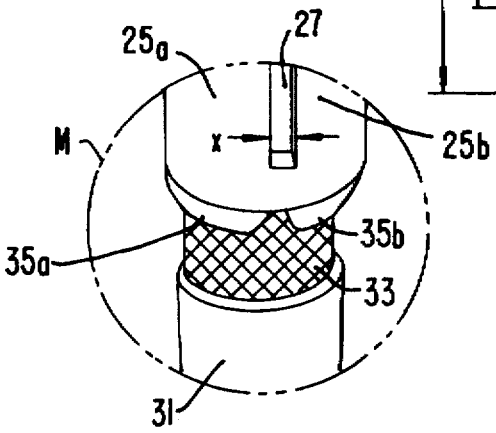

FIG. 2 illustrates the entire antenna and feed assembly housed in outer case 7 (not shown) to show more fully the antenna in the fully extended position of FIG. 1(*c*). As seen in FIG. 2 (not to scale), collapsible half-wave dipole antenna 1 includes movable dipole arm 3 having a length $L_C$, a static dipole arm 23 having a length $L_S$ from an elevated feed point, and a balun feed assembly 21 located adjacent and parallel to static dipole arm 23. When in the fully extended position, movable dipole arm 3 is parallel to both balun 21 and smile dipole arm 23. In this position, movable dipole arm 3 extends from an elevated feed point opposing static arm 23. In either the fully extended or collapsed position, movable dipole arm 3 is offset from static dipole arm 23 by a distance $D_1$, and offset from the center of balun 21 at the feed point by a distance $D_2$. The length $L_S$ of static arm 23 is offset from the center of balun 21 at the feed point by a distance $D_3$. In the fully collapsed position (FIG. 1(*a*)), movable dipole arm 3 lies adjacent and parallel to balun 21 and is also adjacent and parallel to static dipole arm 23.

As seen in FIG. 2, balun assembly 21 includes a pair of metal balun lines $25_a$ and $25_b$, and the coaxial dielectric 27 and the coaxial center conductor 29 of coaxial input cable 11. As is well known of coaxial cables, coaxial center conductor 29 is surrounded by coaxial dielectric 27. Having a length $L_B$, balun fines $25_a$ and $25_b$ support the dipole arms 3 and 23. Each balun line 25 is made of a conducting material having a semi-circular cross-section with a specific thickness (t) and radius (r), in a specific embodiment. Balun lines $25_a$ and $25_b$ are separated on each side along their lengths by a distance x. The present preferred embodiments of the single-line symmetrical balun use overcompensated slotted line baluns, but other embodiments may use compensated slab line baluns, undercompensated open line baluns, or other baluns. In other embodiments, balun lines 25 may have different cross-sections with other dimensions. Static arm 23 lies adjacent and parallel to balun line $25_a$ for most of its length, except near the elevated feed point where static arm 23 curves and joins balun line $25_a$. Static arm 23 is approximately the same physical length as movable dipole arm 3. As mentioned above, the electrical length of the dipole antenna 1 preferably equals a half-wavelength of the center frequency of operation.

As shown in a detailed view M (see FIG. 2(*b*)) of the base of balun 21 in FIG. 2, part of coaxial input cable 11 is stripped to expose its component parts: a coaxial outer jacket 31, a coaxial outer conductor 33 underneath coaxial outer jacket 31, and coaxial dielectric 27 underneath metal shielding 33. At one end indicated by M, balun lines $25_a$ and $25_b$ are electrically connected. In balun assembly 21, the pair of balun lines $25_a$ and $25_b$ runs parallel to and sandwiches coaxial dielectric 27 and center conductor 29 (not shown in view M). Balun connections $35_a$ and $35_b$ electrically connect balun lines $25_a$ and $25_b$, respectively, to outer conductor 33, which is in the form a shielding sheath of coaxial cable 11. Of course, balun connections 35 may be separate or joined, and may be coupled using solder, a press fit, or like mechanism suitable for maintaining an electrical connection.

In addition, balun lines $25_a$ and $25_b$ are electrically connected to dipole arms 23 and 3, respectively, at the opposite end of balun 21, as shown in a detailed view N in FIG. 2. As seen in the detailed view of N (see FIG. 2(*a*)), center conductor 29 (enclosed within coaxial dielectric 27 in the coaxial input cable 11) is connected electrically to the junction of balun line $25_b$ and movable dipole arm 3. This electrical connection is achieved using a pressurized or positive sliding physical contact 37, which is fastened to center conductor 29. Sliding physical contact 37 extends laterally a distance $D_2$ from coaxial center conductor 29, also engaging balun line $25_b$, at an elevated feed point in order to contact a point along the length of movable dipole arm 3. According to a specific embodiment, sliding contact 37 is a thin, flat, springy, conducting material, bent at one end to form a sliding contact with movable dipole arm 3 to provide the constant electrical connection. Sliding contact 37 is capable of contacting movable dipole arm 3 anywhere along its length between tip 5 (located at the top of arm 3 and which is always exterior to outer case 7) and a slide stop 39 (located at the bottom of arm 3 and which is always interior to outer case 7). Additionally, sliding contact 37 may be furnished with a catching mechanism, for example an angular hook, at the point of contact with dipole arm 3, to more easily engage slide stop 39. Optionally, dipole arm 3 may be enclosed with a protective covering, such as plastic, except uncovered at the detent near tip 5 and at a portion contacting arm 3 when fully extended. Accordingly, sliding contact 37 may make physical and electrical contact with conducting material of dipole arm 3 through the protective covering, enabling retractable operation of the antenna in the both the fully extended and fully collapsed positions.

Used in conjunction with the catch mechanism of sliding contact 37, slide stop 39 prevents movable dipole arm 3 from completely sliding out of outer case 7. Slide stop 39 may be any suitable small protrusion at the bottom end of retractable dipole element 3. In specific embodiments, slide stop 39 may be a thin circular plate having a diameter slightly larger than the diameter along the length of retractable dipole element 3, as seen in detailed view N of FIG. 2. The resulting coax feeds in parallel (a) the dipole arms 23 and 3, and (b) balun lines $25_a$ and $25_b$, both shorted at end M to the shielding sheath and having balun line $25_b$ coupled at end N to center conductor 29 at the feed point.

In accordance with an alternative specific embodiment as seen in FIG. 1(*d*), collapsible antenna 1 may be equipped with movable dipole arm 3 which is coupled to balun assembly 21 near the feed point by a pivot mechanism 40 located at the end of fixed contact 38 to provide a pivoting contact to arm 3, rather than a sliding contact. Contact 38 extends laterally a distance $D_2$ from where it is attached to coaxial center conductor 29. Fixed contact 38 also engages balun line $25_b$, at an elevated feed point in order to contact a point along the length of movable dipole arm 3. According to a specific embodiment, contact 38 is a flat, conducting material, coupled at one end to joint 40 to form a fixed, movable contact with one end of movable dipole arm 3 to provide the constant electrical connection. The pivot mechanism 40 provides arm 3 with two-dimensional rotational motion. Optionally, dipole arm 3 may be covered along its length with a protective layer, except near joint 40 where electrical contact is made with conducting material of arm 3. Accordingly, contact 38 and pivot 40 provide physical and electrical contact between center conductor 29 and conducting material of dipole arm 3, enabling collapsible operation of the antenna in the both the fully extended and fully collapsed positions.

According to specific embodiments, the system is electrically balanced and impedance matched in both the extended and collapsed positions. The balun acts as an electrical reflector that prevents currents from reflecting back into the feed line. Reflection of currents into the feed line undesirably causes a high VSWR and may cause overheating at the amplifier. Testing for VSWR has determined that it is important to have balun assembly 21 parallel to and in the same plane as static arm 23. Although folding of the static arm 23 adjacent to balun 21 reduces the bandwidth of the antenna compared to if arm 23 were not folded, folding of static arm 23 results in a smaller antenna assembly, highly suitable for use in portable devices. Testing has also revealed that it is important that static arm 23 is folded next to and parallel to the balun line $25_a$ that is not connected to center conductor 29 of balun 21. It is believed that certain dimensions of antenna 1 may be varied in order to produce optimal impedance matching to provide low VSWR. The distance $D_2$ between dipole arm 3 and center conductor 29 of balun 21, and the distance $D_3$ between static dipole arm 23 and center conductor 29 of balun 21, are factors in optimizing the antenna's bandwidth. Further, the diameter of radiating arm 3 and cross-sectional dimensions of arm 23 are important to the antenna's bandwidth. The balun length $L_B$ is preferably about a quarter-wavelength of the operating center frequency, and it may be varied slightly as a tuning factor in impedance matching the antenna. The dimensions of balun lines $25_a$ and $25_b$ are also believed to be important for bandwidth. Balun lines 25 constructed of a smaller radius reduces the effective bandwidth. In a specific embodiment where the center operating frequency is about 915 MHz, the balun length $L_B$ is about 8 cm, the length of dipole arm 3 $L_C$ is about 10 cm, and the length of dipole arm 23 $L_S$ is about 7 cm. Also, distance $D_1$ is about 1.0 to 1.6 cm, with distances $D_2$ and $D_3$ being about 0.4 cm and about 1.2 cm, respectively, for the specific embodiment. The diameter of arm 3 is about 0.1 cm, and the cross-sectional dimensions of arm 23 are about 0.15 cm×0.15 cm. Each balun line $25_a$ and $25_b$ has a radius r of about 0.2 cm and thickness t of about 0.05 cm. Balun lines 25*a* and 25*b* are separated (on each side) from each other by a distance x of about 0.5 mm. Of course, it is recognized that the above mentioned dimensions may be tuned in various combinations to provide optimized results. As indicated by the performance data discussed below, the bandwidth is about 30 MHz for the half-wave antenna, which performs well in the fully extended position as well as in the fully collapsed position.

Figure 3A:
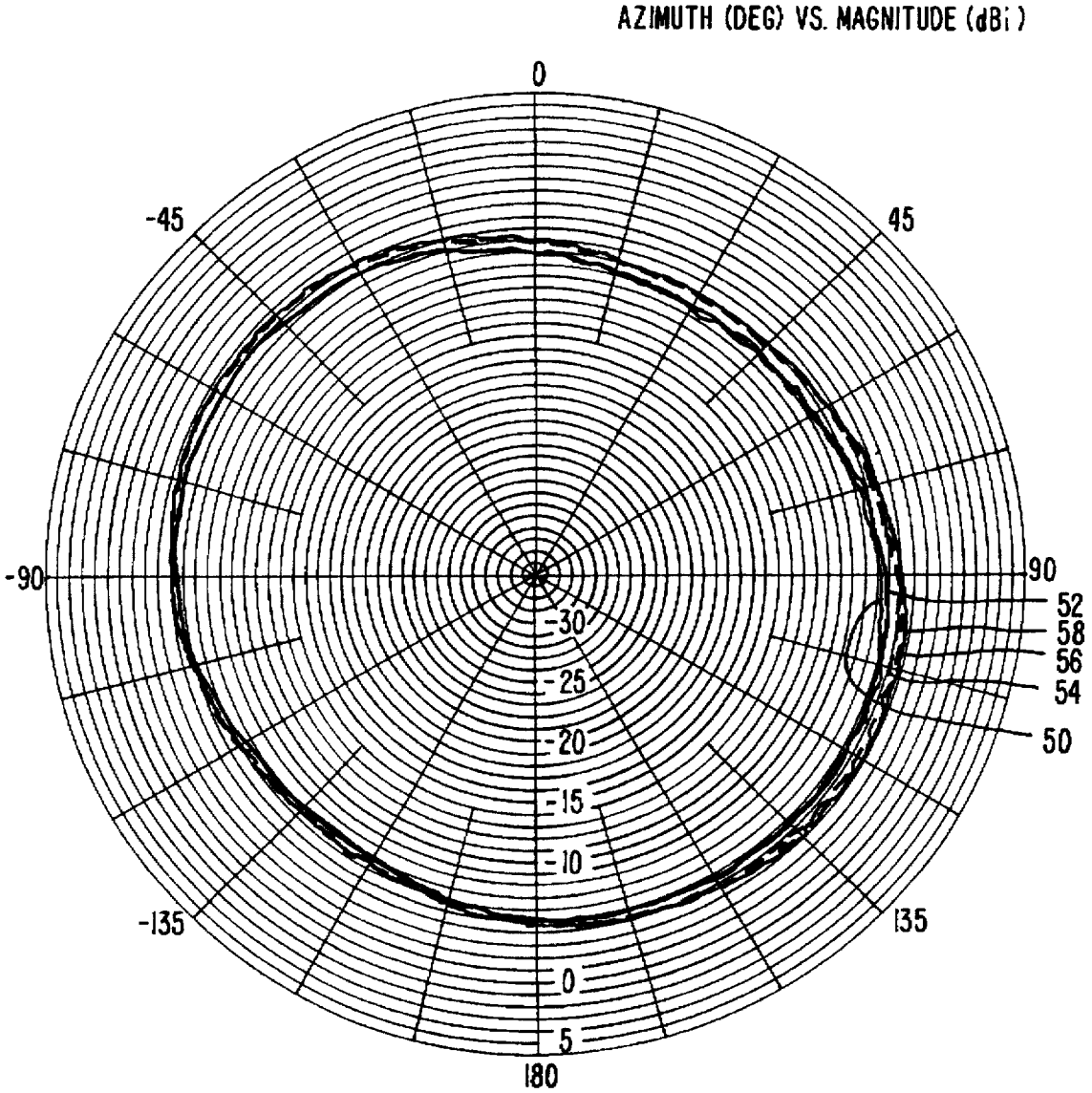
FIGS. 3(*a*)–3(*b*) are diagrams illustrating the radiation patterns of the collapsible dipole antenna in a fully collapsed position and a fully extended position, respectively.
Figure 3B:
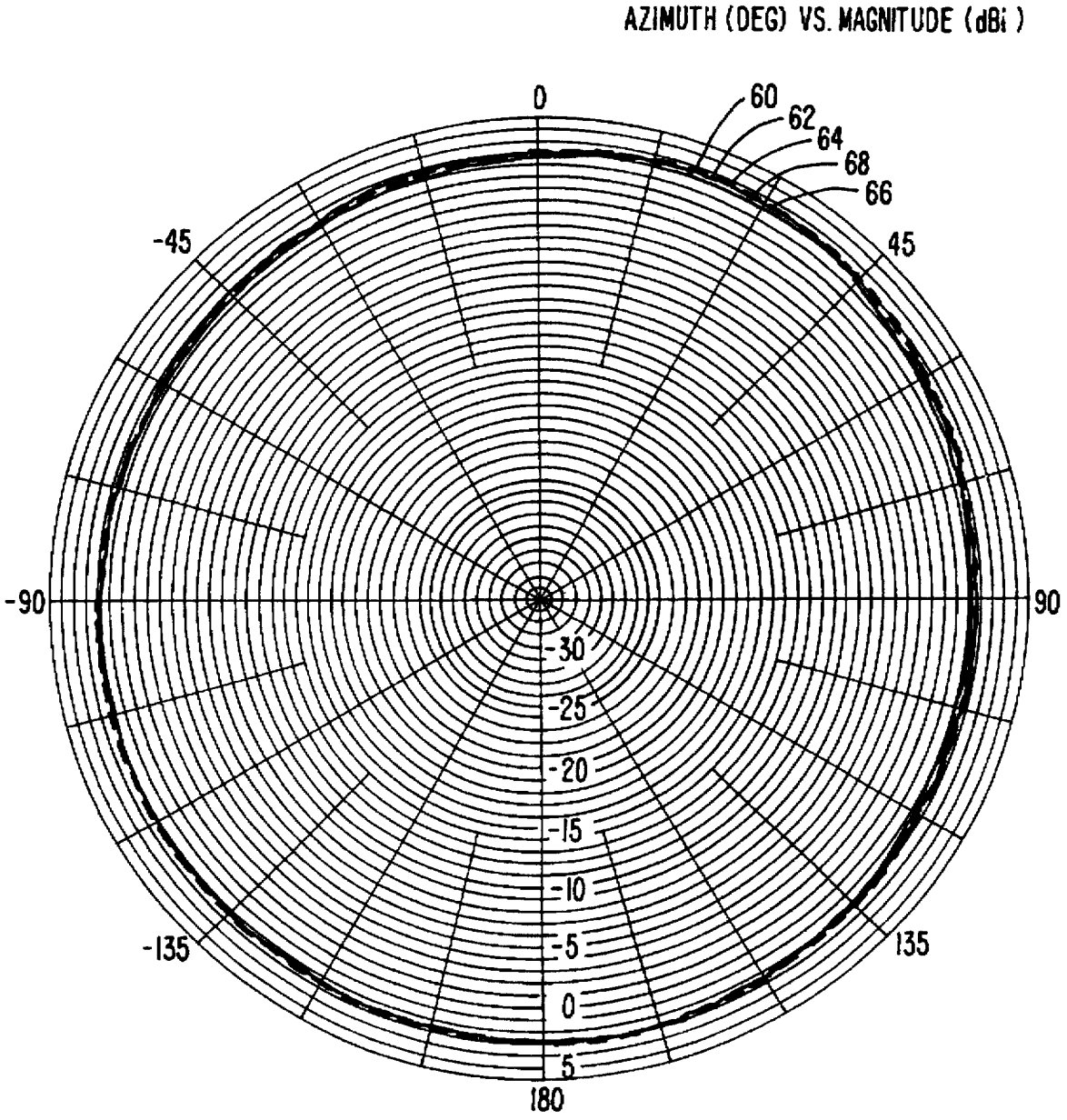

In accordance with the specific retractable embodiment of FIGS. 1(*a*)–1(*c*), FIGS. 3(*a*)–3(*b*) are diagrams illustrating the radiation patterns of the collapsible dipole antenna in a fully collapsed position and a fully extended position, respectively. The measured radiation patterns provide performance information in azimuth (ϕ) degrees versus magnitude over a range of frequencies (between about 900 to about 930 MHz) as the antenna would perform in free space. In FIGS. 3(*a*)–3(*b*), dipole antenna is located at the center of the circular graph, oriented lengthwise (for example, along length $L_S$) in a direction perpendicular to the page and oriented widthwise (along distance $D_1$ from static arm 23 to movable arm 3) in a direction along the axis from 0° to 180°. FIG. 3(*a*) shows plots 50, 52, 54, 56, and 58 of radiation patterns for the fully collapsed antenna operating at frequencies of about 902 MHz, 909 MHz, 915 MHz, 920 MHz and 928 MHz, respectively. When in the fully collapsed position, the collapsible dipole antenna exhibits radiation magnitudes measured to be between about −10 to −4 dBi (referenced to an isotropic radiator) over the measured frequency range. The radiation pattern exhibited a slightly elliptical shape. More particularly, the antenna radiation reached a minimum of between about −10 to −8 dBi for the measured frequency range at about +30° azimuth, and a minimum of between about −8 to −7 dBi for the measured frequency range at about −150° azimuth, as seen in FIG. 3(*a*). The antenna radiation reached a maximum of between about −6 to −4 dBi for the measured frequency range at about +120° azimuth, and a maximum of between about −5 to −4 dBi for the measured frequency range at about −60° azimuth. It appears that the radiation from the fully collapsed antenna is generally omni-directional though somewhat minimized or maximized at certain points.

As shown in FIG. 3(*b*), when in the fully extended position, the collapsible dipole antenna exhibits power magnitude measured to be between about 0 to 3 dBi over the same measured frequency range. FIG. 3(*b*) shows plots 60, 62, 64, 66, and 68 of radiation patterns for the fully extended antenna operating at frequencies of about 902 MHz, 909 MHz, 915 MHz, 920 MHz, and 928 MHz. The radiation pattern exhibited a circular shape indicating improved omni-directionality is obtained with the fully extended antenna, as compared with the fully collapsed antenna. More particularly, the antenna radiation reached a minimum of between about 0 to 1 dBi for the measured frequency range at about −60° azimuth, and a minimum of between about 0.5 to 1.5 dBi for the measured frequency range at about +120° azimuth, as seen in FIG. 3(*a*). The antenna radiation reached a maximum of between about 2 to 3 dBi for the measured frequency range at about +30° azimuth, and a maximum of between about 1.5 to 2.5 dBi for the measured frequency range at about −150° azimuth. It appears that the radiation from the fully extended antenna exhibits higher gain and improved omni-directionality compared to the fully retracted position. The fully extended antenna continues to exhibit a very slight elliptical pattern, with radiation minimized or maximized at certain points. The measured output radiation of the present invention (in the extended position) had about a 4 dBi margin improvement over commercially available portable half-wavelength monopole antennas. It is also believed that the somewhat elliptical shape of the radiation pattern is partly due to problems relating to the ground plane during testing, and that the antenna in free space would exhibit a more omni-directional radiation pattern.

Figure 4A:
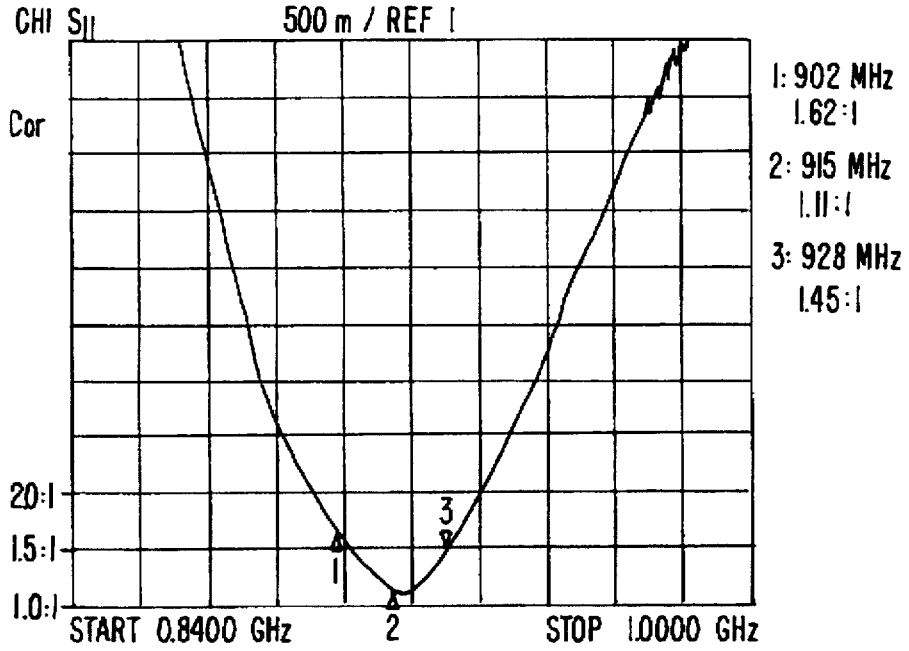
FIGS. 4(*a*)–4(*b*) are diagrams illustrating the VSWR exhibited by the collapsible dipole antenna in a fully collapsed position and a fully extended position, respectively.
Figure 4B:
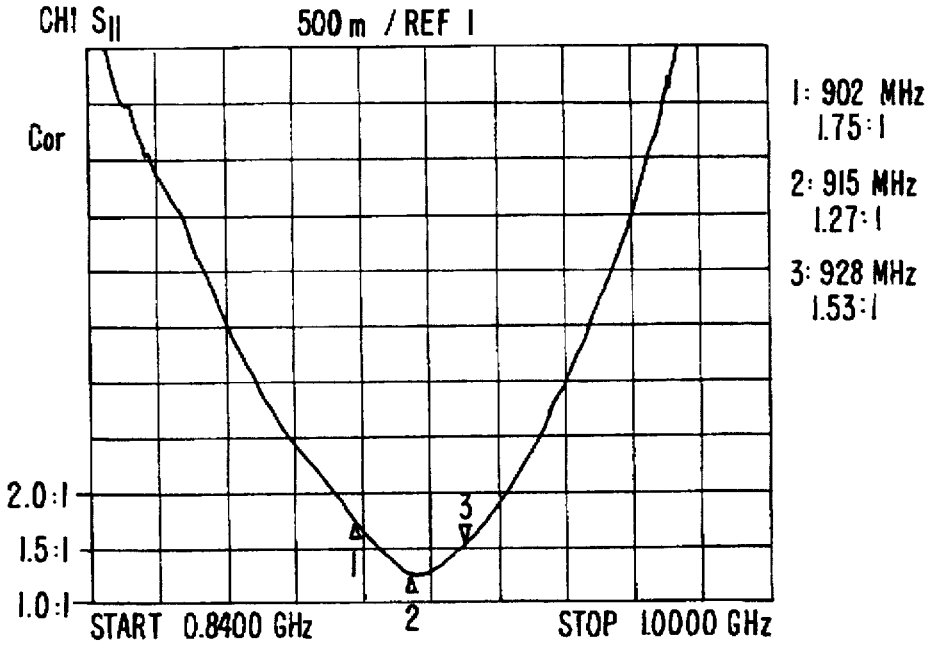

FIGS. 4(*a*)–4(*b*) are diagrams illustrating the VSWR exhibited by the collapsible dipole antenna in a fully retracted position and a fully extended position, respectively, in accordance with the specific retractable embodiment. The VSWR data provide information over a frequency range of 840 MHz to 1.0 Gigahertz (GHz) with a center frequency at 915 MHz. As seen in FIG. 4(*a*), the collapsible dipole antenna in the fully collapsed position exhibits VSWRs of about 1.62:1 at 902 MHz, about 1.11:1 at 915 MHz, and about 1.45:1 at 928 MHz. The collapsible dipole antenna in the fully extended position exhibits VSWRs of about 1.75:1 at 902 MHz, about 1.27:1 at 915 MHz, and about 1.53:1 at 928 MHz, as seen in FIG. 4(*b*). As FIGS. 4(*a*)–4(*b*) demonstrate, the specific embodiment of the present collapsible dipole antenna exhibits good VSWR (<2.0:1) between 902 and 928 MHz in the extended position and, unexpectedly, even better VSWR (<1.7:1) in the collapsed position. Improved VSWR measurements of the present antenna in the retracted position may be obtained by optimizing the various physical dimensions of the antenna.

Figure 5A:
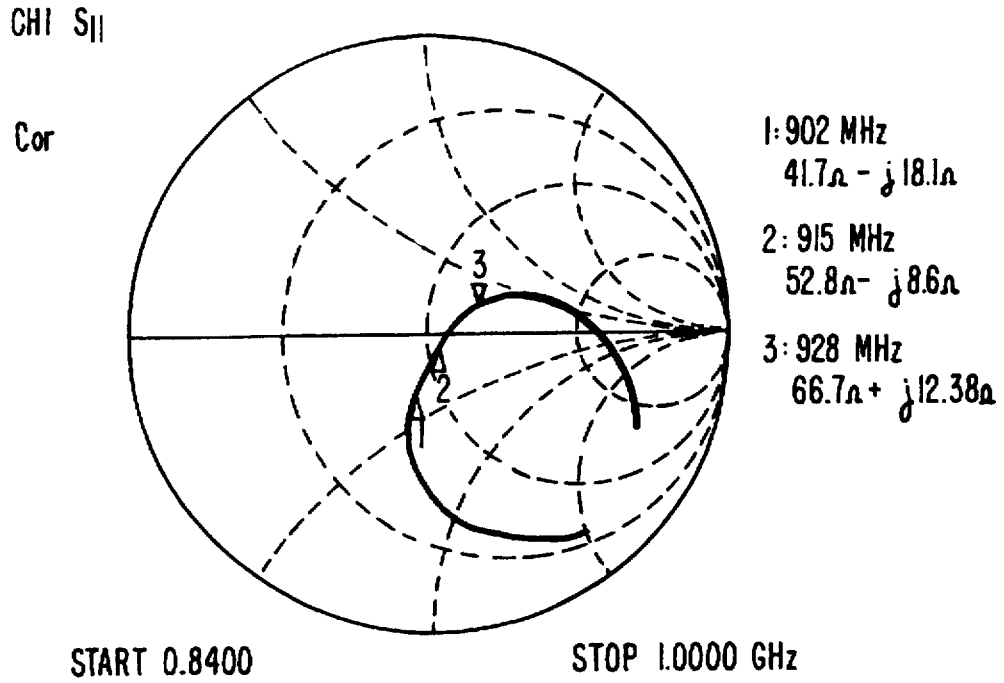
FIGS. 5(*a*)–5(*b*) are Smith charts of the collapsible dipole antenna in a fully collapsed position and a fully extended position, respectively.
Figure 5B:
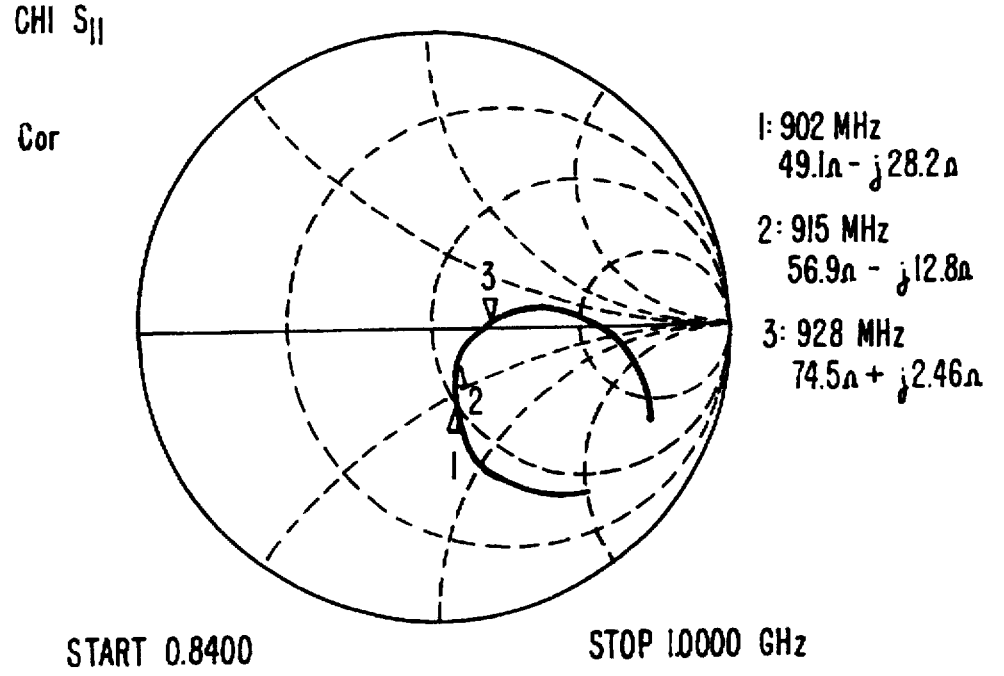

According to the specific retractable embodiment, FIGS. 5(*a*)–5(*b*) are Smith charts of the collapsible dipole antenna in a fully collapsed position and a fully extended position, respectively. The Smith charts provide input impedance information over a frequency range from 840 MHz to 1.0 Gigahertz (GHz). As seen in FIG. 5(*a*), the collapsible dipole antenna in the fully collapsed position exhibits an input impedance of about 41.7 ohm (Ω) impedance with some capacitance at 902 MHz, about 52.8 Ω impedance with some capacitance at 915 MHz, and about 66.7 Ω impedance with some inductance at 928 MHz. As seen in FIG. 5(*b*), the collapsible dipole antenna in the fully extended position exhibits an input impedance of about 49.1 ohm (Ω) impedance with some capacitance at 902 MHz, about 56.9 Ω impedance with some capacitance at 915 MHz, and about 74.5 Ω impedance with some inductance at 928 MHz. The Smith charts shown in FIGS. 5(*a*)–5(*b*) illustrate that the input impedance of the retractable dipole antenna is generally well-matched to the characteristic impedance of the coaxial input cable around the operating frequency.

The present invention has been explained with relation to specific embodiments. It is to be understood that the above description is intended to be illustrative and not restrictive. Many embodiments will be apparent to those of skill in the art upon reviewing the above description. The scope of the invention should, therefore, be determined not with reference to the above description, but should instead be determined with reference to the appended claims, along with the full scope of equivalents to which such claims are entitled.

What is claimed is:

1. A collapsible half-wavelength dipole antenna for use in a portable device, said antenna having a fully collapsed position and a fully extended position, said antenna comprising:

a static dipole arm;

a movable dipole arm, said movable dipole arm capable of being moved to the fully collapsed position and the fully extended position;

a balun feed assembly, said balun feed assembly electrically coupled to said static dipole arm and to said movable dipole arm, said antenna capable of transmitting and receiving electrical signals in either the fully collapsed position or the fully extended position, said balun feed assembly fixed to said static dipole arm, and said movable dipole arm movably coupled to said balun feed assembly.

2. The antenna of claim 1 wherein said balun feed assembly comprises a single-line, symmetrical balun feed that includes a contact and a center conductor covered with dielectric that is sandwiched by a first balun line and a second balun line, said balun feed assembly having an electrical length of about a quarter-wavelength of the operating center frequency.

3. The antenna of claim 2 wherein said static dipole arm is positioned adjacent and parallel to said balun feed assembly and is fixed at a feed point to said first balun line, and said movable dipole arm is coupled to said center conductor and said second balun line at the feed point, wherein said antenna forms a folded half-wavelength dipole antenna when said movable dipole arm is in the fully collapsed position and a half-wavelength dipole antenna when said movable dipole arm is in the fully extended position.

4. The antenna of claim 2 wherein said balun feed assembly has a physical length of about 8 cm or less.

5. The antenna of claim 2 wherein said static dipole arm has a physical length of about 7 cm or less, and said movable dipole arm has a physical length of about 10 cm or less.

6. The antenna of claim 5 wherein said movable dipole arm and said static dipole arm are separated at a feed point by a distance ($D_1$) of about 1.6 cm.

7. The antenna of claim 5 wherein said movable dipole arm is separated from a center conductor of said balun feed assembly at a feed point by a distance ($D_2$) of about 0.4 cm.

8. The antenna of claim 5 wherein said static dipole arm is separated from a center conductor of said balun feed assembly at a feed point by a distance ($D_3$) of about 1.2 cm.

9. The antenna of claim 2 wherein said balun feed assembly comprises an overcompensated slotted line balun.

10. The antenna of claim 9 wherein each of said first and second balun lines has a thickness of about 0.05 cm and a radius of about 0.2 cm.

11. The antenna of claim 10 wherein said first and second balun lines are separated from each other on each side by a distance of about 0.5 mm.

12. The antenna of claim 1 wherein said movable dipole arm is rotatably coupled to said balun feed assembly.

13. The antenna of claim 12 wherein said movable dipole arm is electrically coupled to said balun feed assembly via a joint.

14. The antenna of claim 13 wherein said movable dipole arm is coupled to said balun feed assembly by said joint, said joint allowing two-dimensional rotational movement.

15. The antenna of claim 13 wherein said movable dipole arm is covered with a protective layer except near said joint.

16. The antenna of claim 1 wherein said movable dipole arm is slideably coupled to said balun feed assembly.

17. The antenna of claim 16 wherein said movable dipole arm is electrically coupled to said balun feed assembly via a sliding contact.

18. The antenna of claim 17 wherein said movable dipole arm is coupled to said balun feed assembly by a sliding physical contact.

19. The antenna of claim 17 wherein said movable dipole arm includes a tip and a base.

20. The antenna of claim 19 wherein said movable dipole arm is covered with a protective layer except near said tip and near said base, said tip and said base making electrical contact with said sliding physical contact.

21. The antenna of claim 1 wherein said antenna has acceptable gain in both the fully collapsed position and the fully extended position.

22. The antenna of claim 21 wherein said antenna has a VSWR of less than about 2.0:1 in both the fully collapsed position and the fully extended position.

23. The antenna of claim 22 wherein said antenna has a better VSWR in the fully collapsed position compared with that of the fully extended position.

24. A method of making a collapsible half-wavelength dipole antenna for use in a portable device, said method comprising:

providing a balun feed assembly;

providing a static dipole arm and a movable dipole arm, both coupled to said balun feed assembly, said movable dipole arm capable of being moved into a collapsed position and an extended position; and optimizing performance of said antenna by varying different dimensions of said antenna to produce an antenna capable of acceptable gain and VSWR in both the collapsed and extended positions.

* * * * *